US005401039A

United States Patent [19]

Wolf

[11] Patent Number: 5,401,039

[45] Date of Patent: Mar. 28, 1995

[54] VENTILATED IN-LINE ROLLER SKATE

[76] Inventor: David Wolf, 78 Brackett Rd., Newton, Mass. 02158

[21] Appl. No.: 84,538

[22] Filed: Jun. 28, 1993

[51] Int. Cl.[6] ..... A63C 17/06

[52] U.S. Cl. ..... 280/11.22; 36/3 R; 36/115; 280/811

[58] Field of Search ..... 36/3 R, 3 A, 3 B, 115; 180/68.1, 68.2; 280/841, 11.19, 11.22, 11.23, 11.27, 809, 811

[56] References Cited

U.S. PATENT DOCUMENTS

| | | | |
|---|---|---|---|
| 2,552,711 | 5/1951 | Dunker | 36/3 R |
| 3,273,264 | 9/1966 | Farinello, Jr. | 36/3 A |
| 4,387,780 | 6/1983 | Fujikawa | 180/68.1 |
| 5,171,033 | 12/1992 | Olson et al. | 280/11.22 |

FOREIGN PATENT DOCUMENTS

| | | | |
|---|---|---|---|
| 4745 | 3/1993 | WIPO | 280/809 |

*Primary Examiner*—Margaret A. Focarino
*Assistant Examiner*—Michael Mar
*Attorney, Agent, or Firm*—Wolf, Greenfield & Sacks

[57] ABSTRACT

A ventilated in-line skate having a boot with a frame that supports a plurality of wheels having the axles in a longitudinal array. Ventilating means for the boot are formed by a rotor having a plurality of vanes that are coaxially mounted and secured for rotation with one wheel. A housing having an opening defining an air scoop encloses the rotor and is connected to one end of an air conduit that may be secured to the frame with its other end in fluid communication with the interior of the boot through a series of openings in the bottom side of the boot. Exit holes or apertures are formed at the rear of the boot to promote escape of air.

7 Claims, 2 Drawing Sheets

VENTILATED IN-LINE ROLLER SKATE

SUBJECT MATTER OF THE INVENTION

The present invention relates to a dynamic air circulation system for a boot of an attached roller skate.

BACKGROUND OF THE PRESENT INVENTION

With the current popularity of in-line roller skates, attention has been directed to the problem of heat build-up in the boot during extensive use, especially during hot days. This problem is addressed in U.S. Pat. No. 5,171,033. In that patent the problem described is exascerbated by the materials used in making the ski-type boots currently used in in-line skates as well as by the rigidity of the boot itself. Additionally, the lack of air circulation within the boot causes build-up of moisture. This combination of excessive heat and dampness makes the use of these boots less desirable.

Heretofore, the solutions advanced for dealing with these problems have been limited. In the cited patent, the solution advanced is to provide the boot with ventilating holes in combination with a free-floating liner. This combination is intended to create an air pumping action between the liner and the outer shell during use of the skate.

At best, such systems have limited utility because the pumping action, if any, necessarily is localized to the area of the ventilating hole and because the ventilating system relies essentially on a misfit between the wearer's foot and the outer shell. In addition, the pumping action, if it occurs at all, necessarily occurs on the upper portions of the boot in the immediate area of the ventilating holes, and thus provides cooling, if at all, to a limited portion of the wearer's foot. In addition, the quantity of air that is moved through the boot is limited because movement of the wearer's foot is limited. Since pumping action occurs no more than once in each step of the wearer, there is no cooling action during gliding, which is common during skating both on flat terrain and downhill areas.

OBJECT OF THE PRESENT INVENTION

It is a principle object of the present invention to provide a new and improved means and method for dynamically moving air to the interior of a roller skate boot.

A further object of the present invention is to provide an improved in-line roller skate design in which a positive dynamic means is provided for continually pumping air through the boot as the skate moves.

A further object of the present invention is to provide an improved in-line roller skate construction utilizing a simple mechanism, automatically operable for moving air through the boot at selected locations of the boot including, specifically, from the bottom of the boot.

One more object of the present invention is to provide a turbine or rotor-like means for pumping air in a positive fashion into a boot with the rotor keyed to rotation of at least one of the wheels of a roller skate and with the rotor located on the skate in a manner as not to interfere with other operations of the roller skate.

A still further object of this invention is to provide improved means for moving air through a roller skate boot constantly as the skate moves in greater volumes than heretofore possible.

SUMMARY OF THE PRESENT INVENTION

The present invention provides an improved roller skate with an attached boot having a ventilating means secured to the skate comprising a rotor having a plurality of vanes rotatable with one of the wheels for movement of air as the wheel is rotated. The air is directed through conduit means connected at one end to a housing for the rotor and at the other end to a plurality of selective locations opening into the boot. In the operation of the present invention, rotation of the wheels of the roller skate cause rotation of the rotor and movement of air by the vanes in the housing through the conduit and into the boot at selected locations. The air in the boot moves along the length of the boot and outwardly through an outlet ventilating aperture.

BRIEF DESCRIPTION OF THE DRAWINGS

The present invention may be more fully understood from the drawings, in which.

DETAILED DESCRIPTION OF THE INVENTION

Figure 1:
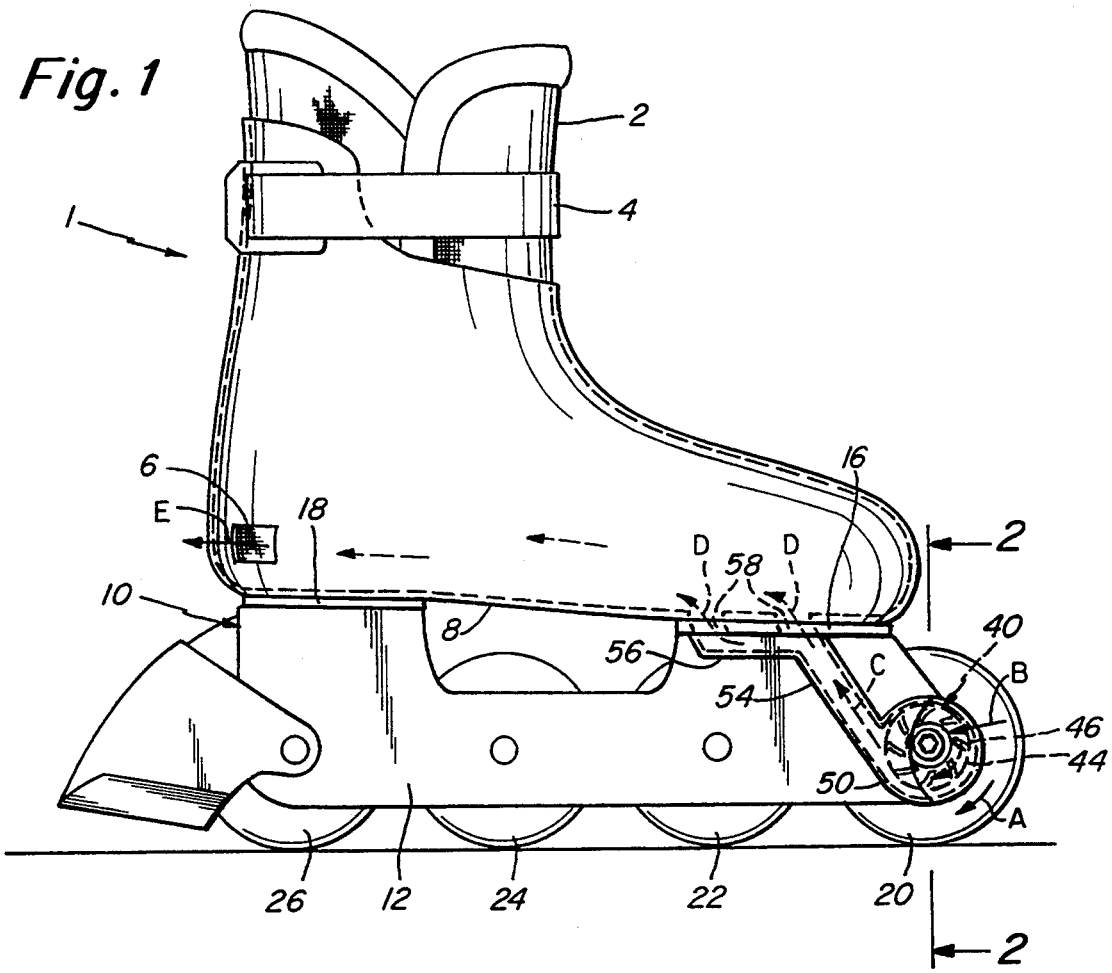
FIG. 1 is a plan elevational view of an in-line roller skate having a boot and frame, including a small fragmented section.

The invention is illustrated in several embodiments of an in-line roller skate. The principles of the invention, however, may be adapted for conventional roller skates in which pairs of wheels are mounted on common axes. In the embodiment illustrated in FIG. 1, a boot 1 is conventionally formed of a relatively hard and rigid plastic outer shell and an inner liner 2 which may be formed of a multiple laminant of fabric materials or the like. Conventional closure means 4 may be provided for the boot 1. In addition, the boot 1 is provided with at least one, and preferably several, apertures or exit holes 6 located in the boot 1 upper preferably towards the rear of the boot. FIG. 1 illustrates a boot 1 having a single aperture 6 on one side. Preferably, however, apertures 6 are symmetrically located on either side of the boot 1. If desired, apertures 6 may be provided in the forward and side portions of the boot 1 as well as in the rear and, in some circumstances, in the sole portion of the boot 1, particularly at the arch or in-step region.

The boot 1 is formed with a sole 8 secured rigidly to a frame 10. The frame 10 may comprise a pair of parallel downwardly extending flanges 12 and 14 that extend lengthwise of the boot and are secured together by forward and rear connection webs 16 and 18. The webs 16 and 18 are rigidly secured to the flanges 12 and 14 by suitable means. Preferably, the unit is integrally molded of steel or relatively durable plastic suitable for the purposes herein intended. The connection web 16 is secured to the forward portion of the boot sole 8 while the connecting web 18 is connected to the heel portion of the boot sole 8 by suitable and conventional means, including by rivets, screwing, or welding.

A plurality of wheels 20, 22, 24, and 26 are positioned in line between the downwardly extending flanges 12 and 14. While the illustrated embodiment shows four wheels, a fewer or greater number of wheels may be used.

Figure 2:
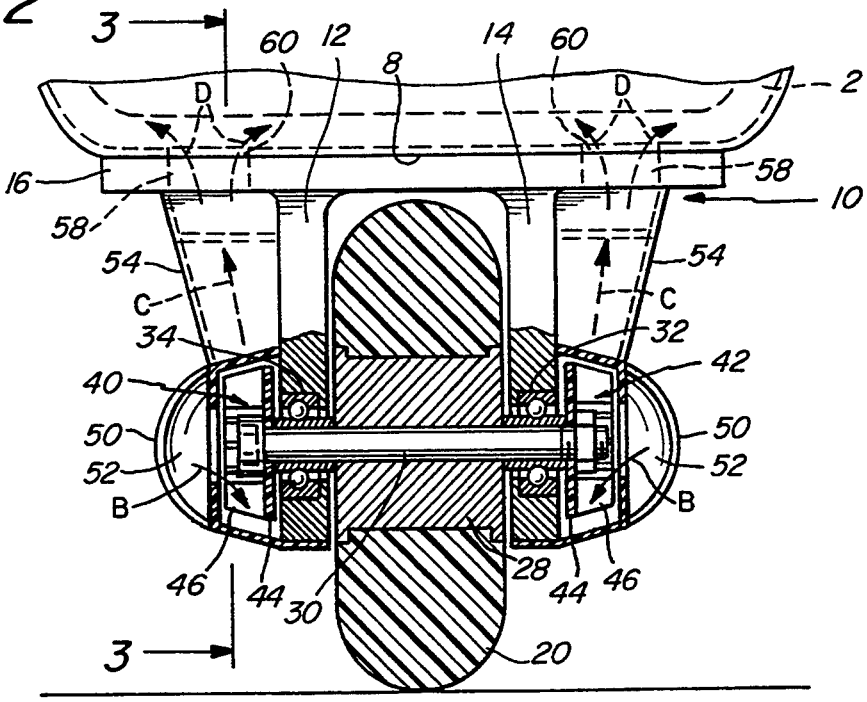
FIG. 2 is a cross-sectional view taken essentially along the line 2—2 of FIG. 1.

Each wheel 20, 22, 24, and 26 is suitably formed, preferably of hard rubber or plastic with a hub 28 in a conventional fashion. As best seen in FIG. 2, an axle 30 extends through the hub 28 and is secured to it for rotation with the hub 28. The axle 30 may be secured to the hub 28 in any suitable fashion, including, for example, by keying the axle to the hub 28 in a conventional fashion. Each axle 30 extends into and is journaled at its ends in roller bearings 32 and 34 which in turn are supported respectively within the flanges 12 and 14.

The axles 30 that extend through wheels 22, 24, and 26 are secured in the frames by suitable means such as locknuts or caps at either end to prevent axial movement.

The axle 30 that extends through wheel 20 and hub 28 also extends beyond the outer surfaces of the downwardly extending flanges 12.and 14. The projecting ends of this axle 30 each engage one of the rotors 40 and 42 positioned respectively on the outer sides of flanges 12 and 14. The rotors 40 and 42 are formed with a supporting platform 44 from which a series of arcuate vanes 46 project (FIG. 1), preferably arranged radially about the axle 30. The vanes are slightly concave in the direction of normal forward rotation of wheel 20.

Housings 50 partially enclose the rotors 40 and 42. The housings 50 in the embodiment of FIG. 1 have a clamshell-like configuration with a relatively large opening 52 directed forwardly to maximize the amount of air directed to the rotors 40 and 42 on rotation of the wheel 20. The housings 50 are each integrally formed with a conduit 54 that may be secured to the outer surface of each of the downwardly extending flanges 12 and 14. The conduits 54 extend upwardly and are integrally connected to passages 56 (FIG. 1) that extend along the length of the boot bottom or sole 8 to selective positions along the boot 1. As seen in FIG. 1, the passages 56 are secured to the boot 1 along the bottom of webs 16 and 18. If desired, the conduit 54 may extend rearwardly of the webs 16 or 18 in engagement with the sole of the boot 8. At selected locations in the webs 16 and 18, apertures 58 are formed for passage of air through the conduits 54 into aligned openings 60 in the sole 8 of the boot 1. Similarly, extensions of the conduits 54 that engage the sole 8 of the boot 1 directly are also connected through openings at their respective ends into the interior of the boot 1.

Figure 3:
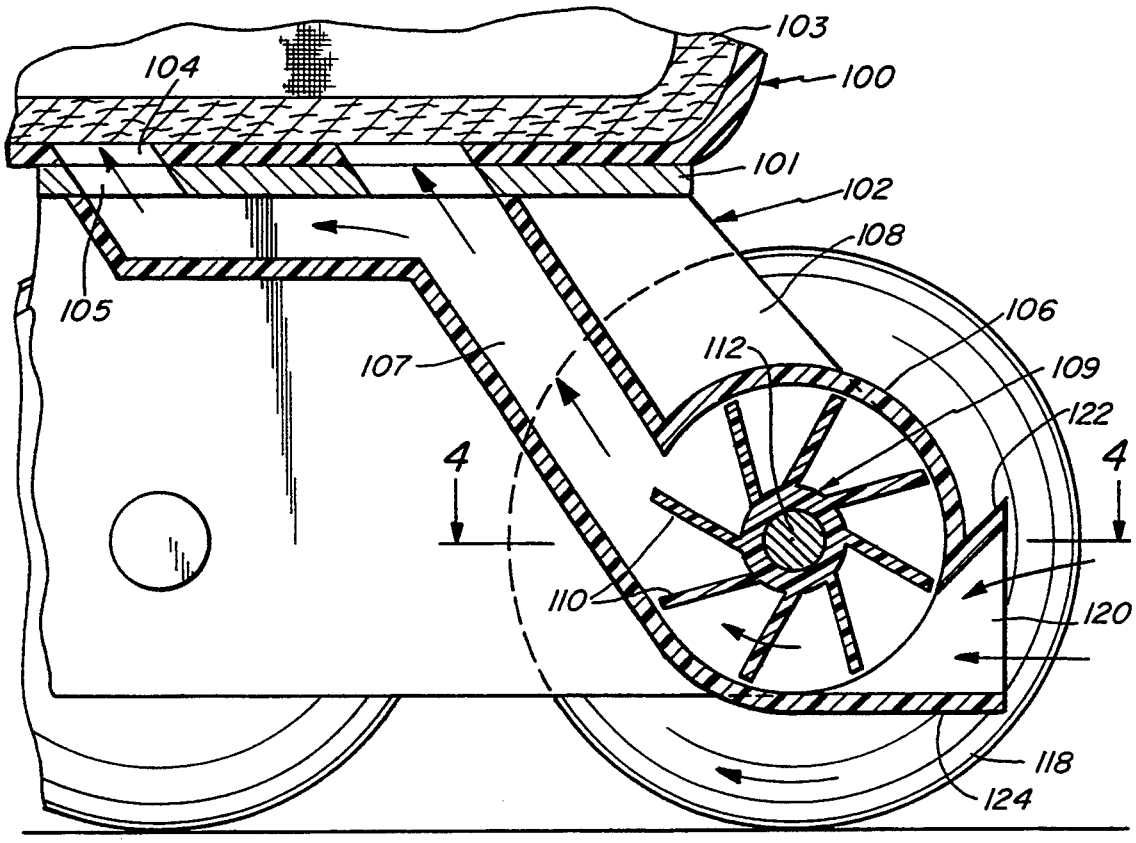
FIG. 3 is a cross-sectional view of a modification of the embodiment of FIG. 1, but taken essentially along the line of 3—3 of FIG. 2.
Figure 4:
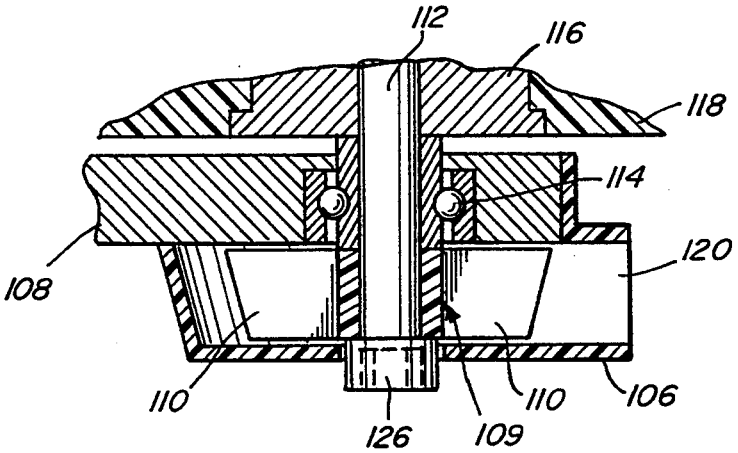
FIG. 4 is a cross-sectional detail taken along line 4—4 of FIG. 3.

A modification of the rotor and housing construction is illustrated in the embodiment of FIGS. 3 and 4. In this configuration, the housing is arranged with the air scoop immediately in front of the rotor so as to narrow the profile of the turbine assembly as illustrated in FIG. 2. In some instances a narrower profile is desired to prevent the rotor from interfering with normal use of the skate on tight turns when the skate is at an acute angle to the ground.

In this arrangement, the boot 100 is suitably secured by rivets (not shown) or other suitable means to the web 101 of the frame 102 in a manner similar to the construction of the embodiment of FIGS. 1 and 2. The boot 100 may be provided with an inner liner 103. Openings 104 in the bottom of the boot are aligned with openings 105 in the web 101 in a manner similar to the construction of FIG. 1.

A housing 106 and an integrally formed air conduit or passage 107 is fixed to the outer surfaces of the downwardly extending flanges 108 of the frame 102 in a manner similar to the housing arrangement of FIGS. 1 and 2. The conduit 107 is in fluid communication with the openings 104 and 105 at one end and at the other and with the housing 106. The housing 106 encloses the rotor 109 which carries vanes 110. The rotor 109 is axially mounted and secured by a key (not shown) or by other means such as cementing to the forward axle 112. The axle 112 is journaled in bearings 114, which in turn are mounted in the downwardly extending flanges 108. The axle 112 is also fixed to and rotates with the hub 116 of wheel 118.

A fluid air scoop 120 is formed in the forward portion of the housing 106 with the width of the air scoop 120 substantially no greater than the width of the housing 106 as illustrated in FIG. 3. The air scoop 120 is formed by diverging upper and lower walls 122 and 124 to form a funnel-like member for directing air inwardly toward the rotor 109. The axle 112 is suitably locked at either end by a lock nut 126. Additional washers and spacers may be appropriately located between the aligned elements in a conventional fashion.

The system operates dynamically as the skate moves forwardly. Thus, as illustrated in FIG. 1, when the skate moves forwardly, the wheels 20, 22, 24, and 26 rotate in the direction of arrow A. Air passing the skate is forced into the housing 50 in the direction of arrows B (FIGS. 1 and 2). Since rotors 40 and 42 are keyed to the wheel 20 and rotates with it in the direction of arrow A, air trapped between the vanes 46 moves to the rear of the housing 50 and into the air conduit 54 in the direction of arrows C. The air is forced upwardly into the boot 1 in the direction of arrows D. As air continues to move through the boot 1, the air within the boot 1 picks up moisture and heat, moving rearwardly through the boot 1 and exiting at aperture or hole 6 in the direction of arrow E.

The operation of the embodiment of FIGS. 3 and 4 is essentially similar to that of FIG. 1 in which like letters identify similar movement of the air in that embodiment.

Having described this invention in detail, those skilled in the art will appreciate that numerous modifications may be made hereof without departing from the spirit of this invention. It is not intended that the scope of this invention be limited to the embodiments illustrated and described. Rather, it is intended that the scope of this invention be determined by the appended claims and their equivalents.

What is claimed is:

1. A ventilated in-line skate having a boot, a frame including a pair of downwardly extending flanges, a plurality of wheels extending in longitudinal array between the flanges, each wheel being supported by an axle secured to the flanges, and means securing the frame to said boot, comprising:

a rotor having a plurality of vanes, said rotor being secured to an axle of one of said wheels and being located outwardly of said frame along an outer surface of a respective flange, a housing at least partially enclosing said rotor and secured to said outer surface of said flange, said housing having a forwardly directed air intake opening, and conduit means extending at least in part outwardly of said flange between said housing and said boot for directing air into the interior of said boot as said one wheel rotates.

2. A ventilated in-line skate as set forth in claim 1, wherein said boot has two openings for receiving air directed by said conduit means.

3. A ventilated in-line skate as set forth in claim 1, wherein said air intake opening has a clamshell-like shape.

4. A ventilated in-line skate as set forth in claim 1, wherein said air intake opening is located forwardly of said rotor.

5. A ventilated in-line skate as set forth in claim 4, wherein said air intake opening has a funnel-like shape.

6. A ventilated in-line skate as set forth in claim 1, having bearing means on said wheels for free rotation thereof relative to said axles, said wheels having hubs in engagement with said bearing means, one of said hubs carrying said rotor for rotation therewith.

7. A skate as set forth in claim 1, wherein said rotor is secured to the foremost of said wheels.

* * * * *